United States Patent [19]

Jensen et al.

[11] Patent Number: 4,716,942

[45] Date of Patent: Jan. 5, 1988

[54] OPTICAL WEFT STOP MOTION FOR LOOMS WITH A U-SHAPED REED

[75] Inventors: Børge R. Jensen, Brussels; Willy M. D. Sierens, Tervuren, both of Belgium

[73] Assignee: Picanol N.V., Belgium

[21] Appl. No.: 898,044

[22] Filed: Aug. 19, 1986

[30] Foreign Application Priority Data

Aug. 26, 1985 [BE] Belgium ..... 60769

[51] Int. Cl.[4] ..... D03D 51/34

[52] U.S. Cl. ..... 139/370.2; 250/571

[58] Field of Search ..... 139/336, 370.2, 370.1; 250/559, 560, 561, 562, 227, 571

[56] References Cited

U.S. PATENT DOCUMENTS

| | | |
|---|---|---|
| 3,853,408 | 12/1974 | Kaalverink . |
| 4,023,599 | 5/1977 | Zeleny . |
| 4,398,570 | 8/1983 | Suzuki et al. . |

FOREIGN PATENT DOCUMENTS

| | | |
|---|---|---|
| 109929 | 5/1984 | European Pat. Off. . |
| 137380 | 4/1985 | European Pat. Off. . |
| 2489854 | 3/1982 | France . |
| 59-163448 | 9/1984 | Japan . |
| 1236346 | 6/1971 | United Kingdom . |
| 2090619 | 7/1982 | United Kingdom ..... 139/370.2 |

*Primary Examiner*—Henry S. Jaudon

*Attorney, Agent, or Firm*—Bacon & Thomas

[57] ABSTRACT

An optical weft stop motion for looms with a U-shaped reed includes an optical emitter, an optical receiver, and a unitary optical conductive plate attachable disposed between the reed lamellae. The plate is provided with a recess which is substantially congruent with and adjacent to the recesses in the U-shaped reed. The optical conductive plate is provided with internal light reflecting side walls which guide the light in the shape of a beam from the emitter through the complete or almost the complete recess of the plate and reflect it further to the receiver.

14 Claims, 5 Drawing Figures

OPTICAL WEFT STOP MOTION FOR LOOMS WITH A U-SHAPED REED

BACKGROUND OF THE INVENTION

This invention relates to an optical weft stop motion for looms with U-shaped reed, in other words a detection element to determine if the shoot extends completely or not through the shed of the loom.

In particular it relates to an optical weft stop motion of the type by which the light of an optical emitter crosses the complete or almost the complete cross section of the tunnel in the U-shaped reed.

DESCRIPTION OF RELATED ART

A known arrangement of this type is described in the European patent application No. 109,929 and consists mainly of one optical emitter, one optical receiver and at least one reflector, whereby the light beam crosses between emitter and receiver across the recess in the U-shaped reed. As the reflectors and the emitter and the receiver according to the known designs do not have a compact design, it is obvious that deviations occur in the reflection of the light signal between the emitter and the receiver. Moreover, with such a design, the passage of light is hampered by the thickness of the reed lamellae, the closeness and the oblique position of the lamellae.

A better solution to reflect the transmitted light beam according to a precisely defined path is provided by the design disclosed in European patent application No. 137.380, whereby mainly two prismatic elements are provided between two adjacent reed lamellae, respectively above and underneath the recesses in the U-shaped reed. However, it is obvious that both prismatic bodies have to be oriented perfectly parallel to each other to obtain the desired reflection of the emitted light signal. So, such an arrangement has the disadvantage that deviations in the path of the light beam may occur easily.

The main disadvantage of the said design consists in the fact that by the use of two prismatic elements, corners and clearances are created between, on the one side, these elements and, on the other side, the adjacent reed lamellae, in which dust accumulation may arise which may cause a wrong indication of the optical weft stop motion. In order to provide a solution for said and other disadvantages the present invention provides an optical weft stop motion which is very effective and reliable.

SUMMARY OF THE INVENTION

For this purpose the invention relates to an optical weft stop motion for looms with a U-shaped reed, consisting in the combination of one optical emitter, one optical receiver and one optical conductive plate attachable between the reed lamellae and which is provided with a form which is congruent or almost congruent with and adjacent to the recesses in the U-shaped reed, whereby the optical conductive plate is provided with internal light reflecting side walls which guide the light in the shape of a beam from the emitter through the complete or almost the complete U-shaped recess of the plate and reflect it further to the receiver, and possibly a number of light blocking or absorbing side walls which exclude a wrong incidence of light.

BRIEF DESCRIPTION OF THE DRAWINGS

In view of a better demonstration of the characteristics according to the invention, hereafter, as examples only without any restrictive character, some preferred embodiments are described. Referring to the accompanying drawings.

DETAILED DESCRIPTION OF PREFERRED EMBODIMENT OF THE INVENTION

As shown in the figures, the invention mainly consists in the combination of one optical emitter 1, one optical receiver 2 and one unitary optical conductive plate 3 for conducting light from the emitter to the collector across a recess in a U-shaped reed.

The optical emitter 1 is formed by a point light source, e.g. a light emitting diode. The optical receiver 2 consists of an arbitrary light sensitive electronic element. Naturally, the emitter 1 as well as the receiver 2 are connected by leads L to appropriate optical or electronic connections to on the one side a power supply and on the other side to a signal processing unit.

The optical conductive plate 3 is made from transparent plastic or possibly glass. It is preferred to use a strip of polycarbonate with a thickness of 0.2 to 0.35 mm.

Figure 2:
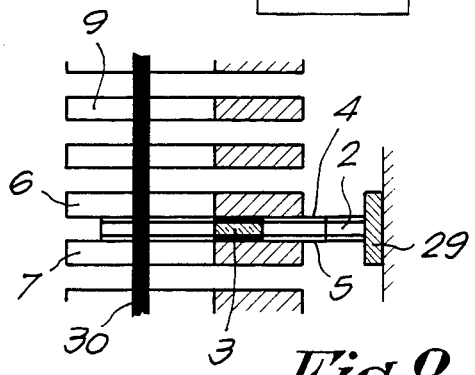
FIG. 2 shows a cross section according to line II—II in FIG. 1.

As shown in FIG. 2, preferably the optically conductive plate 3 is provided with contiguous metal sheets, respectively 4 and 5, made from any possible material, in one shape or another so that the total thickness of the optical detector is in accordance with the mutual distance between two adjacent reed lamellae 6 and 7.

In order to make dust accumulation impossible between the reed lamellae 6 and 7 adjacent to the optical detector, the optical conductive plate 3, as well as the metal sheets 4 and 5, are provided with a recess 8 which is congruent or almost congruent with and adjacent to the recesses 9 which form the tunnel of the U-shaped reed.

Further, the optical conductive plate 3 is provided with reflecting side walls 10 and 11, in one shape or another so that the light beams 12, which are emitted by the optical emitter 1 are reflected in the form of a bundle through almost the complete cross section of the recess 8 and eventually are received by the receiver 2.

The reflections along the side walls 10 and 11 may be of a prismatic nature. However, it is preferred that said side walls 10 and 11 be coated with a light reflecting material. For this purpose e.g. the side walls 10 and 11 are polished and then e.g. provided with a metal layer by means of vacuum deposition, e.g. aluminium.

As the recess 8 according to the invention is congruent or almost congruent with the recesses 9 in the reed lamellae 6 and 7, the side walls 10 and 11 naturally are executed according to the invention in such a manner that, on the one side, always a parallel light beam 13 is obtained in the recess 8 by reflection from the side wall 10 and on the other side, said light beam 13 is reflected completely by the side wall 11 to the optical detector 2.

Figure 1:
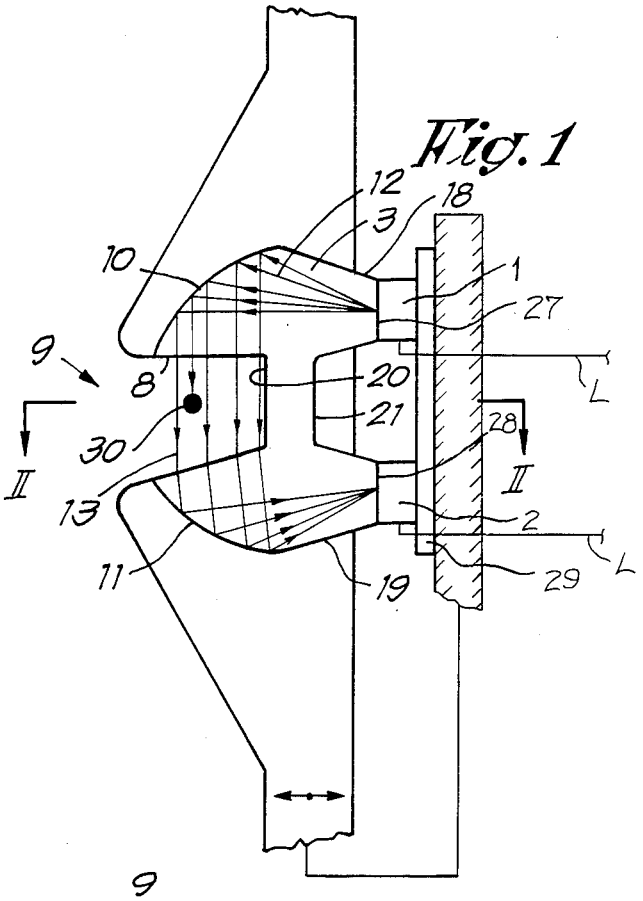
FIG. 1 shows an embodiment of the optical weft stop motion on a large scale.

For that purpose in the embodiments of FIG. 1, the side walls 10 and 11 are made parabolic.

Figure 3:
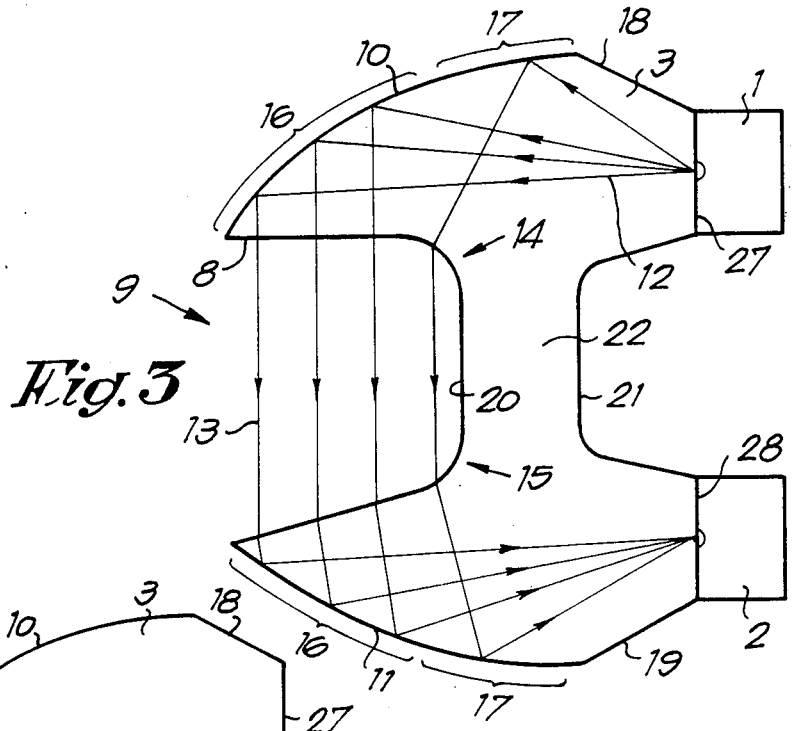
FIG. 3 lines out and shows on a very large scale the path of the light beam in a possible embodiment of an optical conductive plate.

As shown in FIG. 3, the internal corners 14 and 15 of the recesses 8 and 9 are, in the most practical embodiments, are rounded in such a manner that also the form of the reflecting side walls 10 and 11 are adapted to such a degree that the light beam remains almost parallel over the complete cross section of the recess 8 in the optical conductive plate 3. For this purpose, the side walls 10 and 11 each have shapes with parabolic portion 16 and a portion 17 deviating from that shape. The shape of portions 17 is adapted in such a manner that also the light rays which are refracted by the rounded corners 14 and 15 show such a path that, on the one side they form part of the parallel light beam 13, and, on the other side, are reflected to the optical detector 2.

Figure 4:
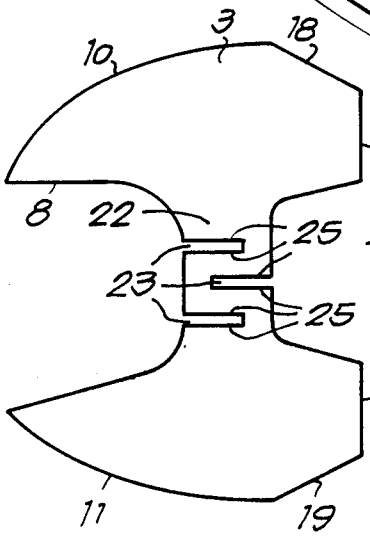
FIGS. 4 and 5 show two variants of the optical conductive plate with respect to the limitation of undesired light passages.
Figure 5:
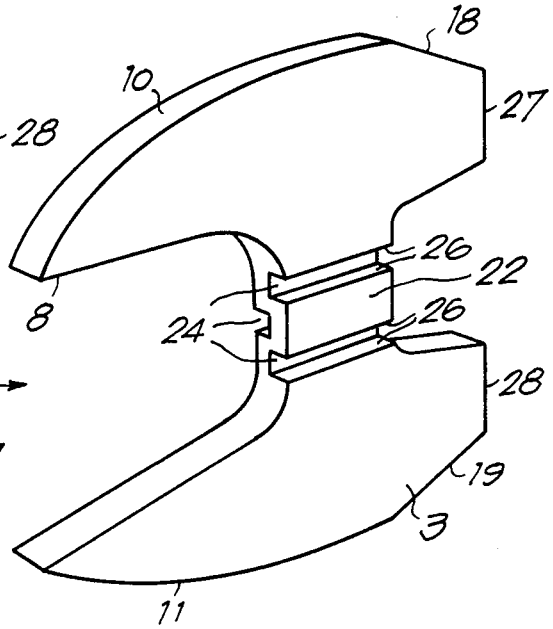

In order to avoid a undesired light reflection within the optical conductive plate 3, it is preferred that one or more side walls 18 to 21 be dulled or painted black. Also the side walls which are adjacent to the lining plates 4 and 5 may, for the same reason, be dulled or painted black partly or completely. In order to avoid a direct light transmission in the optical conductive plate 3 from the optical emitter 1 to the optical receiver 2, it is preferred that the bridge 22, respectively between the portion of the plate 3 which is adjacent to the emitter 1 and the portion which is adjacent to the receiver 2, be made light absorbent, e.g. by coloring it. According to variants which are represented in FIGS. 4 and 5, one may also provide recesses 23 or grooves 24 to limit the direct passage of light between emitter and collector. The inner faces 25 and 26 are preferably painted black.

The optical conductive plate 3 is also provided with connecting faces 27 and 28 on which respectively the optical emitter 1 and the optical receiver 2 are mounted. This may be accomplished e.g. by mounting the optical emitter 1 and the receiver 2 on a supporting plate 29 with a great position accuracy, e.g. by means of techniques as are employed by the fabrication of electronic chips. Further, the supporting plate 29 with the emitter 1 and the receiver 2 may be bonded to the joining or mating faces 27 and 28 on one side, and secured to the reed support structure for movement with the reed on the other side. Naturally, the metal sheets 4 and 5 may provide further necessary stiffening of the assembly.

According to a variant, one may provide the integration of a pre-amplifier or a power supply for the emitter 1 by mounting the emitter 1 and the receiver 2 on the supporting plate 29.

The operation of the optical weft stop motion is easily deduced from the drawings. If a weft thread 30 comes between the recess 8 and the plate 3, a portion of the light beam projected across the recess is interrupted, whereby the incidence of light on the optical receiver 2 is reduced. This is electonically interpreted as the arrival of the weft thread 30.

The present invention is by no means restricted to the exemplary embodiment described and represented in the accompanying drawings, but such an optical weft stop motion can be realized in all kind of forms and dimensions without departing from the scope of the invention.

We claim:

1. An optical weft stop motion for a weaving loom including a reed having lamellae with U-shaped weft guide channels, comprising an optical emitter, an optical receiver and a unitary optically conductive plate optically connected together for transmitting a light signal from the emitter to the receiver through the plate, said emitter, receiver and plate secured to the reed for motion therewith with the plate disposed between a pair of reed lamellae; said plate including a recess substantially congruent with the weft guide channels of the reed lamellae and a bridging portion extending between the light emitter and light receiving sides of the plate, and light reflective sidewalls arranged to transmit light from the emitter across the recess in the plate and to the receiver through said plate.

2. An optical weft stop motion as claimed in claim 1, wherein said light reflective sidewalls include parabolic curved sections arranged to reflect light across the recess from the emitter and from the recess to the receiver.

3. An optical weft stop motion as claimed in claim 1, wherein said plate includes rounded corners at the inner edges of the recess, said light reflecting sidewalls including parabolic curved sections and non-parabolic curved sections, said rounded corners, parabolic curved sections and non-parabolic curved sections arranged to reflect light in parallel rays across the recess from the emitter and from the recess to the receiver.

4. An optical weft stop motion as claimed in claim 1, wherein said reflective sidewalls are coated with reflective material.

5. An optical weft stop motion as claimed in claim 4, wherein said reflective material comprises vacuum deposited metal, for example, aluminum.

6. An optical weft stop motion as claimed in claim 1, said plate including mating surfaces adapted to receive the optical emitter and optical receiver in mating, contiguous relationship.

7. An optical weft stop motion as claimed in claim 1 including a unitary supporting plate to which are secured the optical emitter and receiver.

8. An optical stop motion as claimed in claim 1, said bridging portion of said plate including means for inhibiting transmittal of light therethrough between the optical emitter and receiver.

9. An optical weft stop motion as claimed in claim 8, said light transmitting inhibiting means comprising recesses or grooves extending generally transversely to the light rays transmitted between the emitter and receiver within the plate.

10. An optical weft stop motion as claimed in claim 8, said light transmitting inhibiting means comprising light absorbing material.

11. An optical weft stop motion as claimed in claim 1, including metal sheets contiguous with said optically conductive plate and on opposite sides thereof between the optically conductive plate and adjacent lamellae of the reed.

12. An optical weft stop motion as claimed in claim 11, the side faces of the optically conductive plate adjacent the metal sheets being dulled or coated with black color.

13. An optical weft stop motion as claimed in claim 11, wherein a plurality of sidewalls of said optically conductive plate are light absorbing.

14. An optical weft stop motion as claimed in claim 1, wherein said optically conductive plate comprises a polycarbonate material.

* * * * *